US010977999B2

(12) United States Patent
Lee et al.

(10) Patent No.: US 10,977,999 B2
(45) Date of Patent: Apr. 13, 2021

(54) ORGANIC LIGHT-EMITTING DISPLAY DEVICE

(71) Applicant: LG Display Co., Ltd., Seoul (KR)

(72) Inventors: YunGil Lee, Paju-si (KR); YoungSik Kim, Paju-si (KR); Jonghyun Yun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 207 days.

(21) Appl. No.: 16/023,570

(22) Filed: Jun. 29, 2018

(65) Prior Publication Data

US 2019/0005886 A1 Jan. 3, 2019

(30) Foreign Application Priority Data

Jun. 30, 2017 (KR) ..... 10-2017-0083143

(51) Int. Cl.
*G09G 3/3258* (2016.01)
*G09G 3/3225* (2016.01)

(52) U.S. Cl.
CPC ..... *G09G 3/3258* (2013.01); *G09G 3/3225* (2013.01); *G09G 2300/0814* (2013.01);
(Continued)

(58) Field of Classification Search
CPC ... G09G 3/3233; G09G 3/2014; G09G 3/3241
See application file for complete search history.

(56) References Cited

U.S. PATENT DOCUMENTS

2002/0047839 A1* 4/2002 Kasai ..... G09G 3/325 345/211
2004/0090186 A1* 5/2004 Yoshida ..... G09G 3/3233 315/169.1

(Continued)

FOREIGN PATENT DOCUMENTS

CN 1499471 A 5/2004
CN 102243839 A 11/2011

(Continued)

OTHER PUBLICATIONS

European Patent Office, Extended European Search Report and Opinion, EP Patent Application No. 18180802.3, dated Oct. 29, 2018, eight pages.

(Continued)

*Primary Examiner* — Jennifer Mehmood
*Assistant Examiner* — James S Nokham
(74) *Attorney, Agent, or Firm* — Fenwick & West LLP

(57) ABSTRACT

A display device includes a driving transistor, an organic light emitting diode (OLED), a first switch, and a second switch. The driving transistor has a first terminal (e.g., a drain terminal) and a second terminal (e.g., a source terminal). The OLED includes a first terminal coupled to the second terminal of the driving transistor. The first switch is configured to couple the first terminal of the driving transistor to a first voltage (e.g., VDD) to turn on the OLED, and to couple the first terminal to an intermediate voltage to turn off the OLED. The second switch is configured to couple a second electrode of the OLED to a second voltage (e.g., VSS) to turn on the OLED, and to couple the second electrode of the OLED to the intermediate voltage to turn off the OLED. The intermediate voltage is in between the first voltage and the second voltage.

18 Claims, 8 Drawing Sheets

(52) U.S. Cl.
CPC ..... *G09G 2310/0256* (2013.01); *G09G 2320/0252* (2013.01); *G09G 2330/021* (2013.01)

(56) References Cited

U.S. PATENT DOCUMENTS

| | | | | |
|---|---|---|---|---|
| 2004/0239599 | A1* | 12/2004 | Koyama | G09G 3/3233 345/76 |
| 2005/0052367 | A1* | 3/2005 | Miyazawa | G09G 3/3241 345/76 |
| 2005/0156917 | A1* | 7/2005 | Tobita | G09G 3/3283 345/204 |
| 2008/0074413 | A1* | 3/2008 | Ogura | G09G 3/3233 345/212 |
| 2009/0256783 | A1* | 10/2009 | Mizukoshi | G09G 3/3233 345/76 |
| 2016/0267877 | A1* | 9/2016 | Patel | G09G 3/2014 |
| 2017/0229485 | A1* | 8/2017 | Kimura | G09G 3/3241 |

FOREIGN PATENT DOCUMENTS

| | | | |
|---|---|---|---|
| CN | 102404591 | A | 4/2012 |
| CN | 104658473 | A | 5/2015 |
| CN | 106205486 | A | 12/2016 |
| CN | 108231007 | A | 6/2018 |

OTHER PUBLICATIONS

China National Intellectual Property Administration, Office Action, CN Patent Application No. 201810722312.1, Feb. 23, 2021, nine pages.

* cited by examiner

ORGANIC LIGHT-EMITTING DISPLAY DEVICE

CROSS-REFERENCE TO RELATED APPLICATION

This application claims the priority of Korean Patent Application No. 10-2017-0083143 filed on Jun. 30, 2017, in the Korean Intellectual Property Office, the disclosure of which is incorporated herein by reference.

BACKGROUND

Technical Field

The present disclosure relates to an organic light-emitting display device employed by a virtual reality (VR) device.

Description of the Related Art

Virtual Reality (VR) is an environment that virtually provides a viewer with experiences/environments that she/he cannot have in the real world by way of stimulating the five senses of the human body (sight, hearing, smell, taste, touch) by using artificial technology. Virtual reality can be implemented by using various hardware and software modules such as an input device, an output device, a device driver software, and a content. Typically, a VR device may include an input unit, a processing unit, and an output unit. Among them, the output unit may be implemented as a display device having increased immersion level.

A display device for displaying information plays a very important role for VR devices. In particular, in order to get a viewer immersed into virtual reality, the shape of the VR device is important as well as image presentation performance such as resolution. Accordingly, a head mounted display (HMD) device is frequently used as a kind of VR display devices, which is worn on a user's head. A light and thin display device is appropriate for HMD devices.

Recently, an organic light-emitting display device for an output unit (display device) of VR devices including HMD device has been developed. An organic light-emitting display device employs a self-luminous element using a thin emission layer between the electrodes and is advantageous in that it is light and thin. Accordingly, researches for improving/modifying the structure, operation, and function of the organic light-emitting display device for VR devices are ongoing, considering the use characteristics of VR devices.

SUMMARY

In view of the above, an object of the present disclosure is to provide a pixel circuit of an organic light-emitting display device used in a VR device and a method for driving the same. It should be noted that objects of the present disclosure are not limited to the above-described objects, and other objects of the present disclosure will be apparent to those skilled in the art from the following descriptions.

Disclosed is a display device including a driving transistor, an organic light emitting diode (OLED), a first switch, and a second switch. The driving transistor has a first terminal (e.g., a drain terminal) and a second terminal (e.g., a source terminal). The OLED includes a first terminal coupled to the second terminal of the driving transistor. The first switch is configured to couple the first terminal of the driving transistor to a first voltage (e.g., VDD) to turn on the OLED, and to couple the first terminal to an intermediate voltage to turn off the OLED. The second switch is configured to couple a second electrode of the OLED to a second voltage (e.g., VSS) to turn on the OLED, and to couple the second electrode of the OLED to the intermediate voltage to turn off the OLED. The intermediate voltage is in between the first voltage and the second voltage.

In some embodiments, the OLED is turned off during a first period of the video frame, and the OLED is turned on during a second period of a video frame.

In some embodiments, the first period is a non-emission period, and the second period of the video frame is an emission period, wherein the OLED is configured to emit light during the emission period and the OLED is configured not to emit light during the non-emission period.

In one embodiment, the first period is a data write and hold period for storing display data to a capacitor of the display device.

In some embodiments, the display device further includes a control circuit for controlling the first switch and the second switch.

Disclosed is also a global shutter control circuit including a first switch, a second switch, and a controller. The first switch is configured to be coupled to a driving transistor. The first switch is configured to couple the driving transistor to a first voltage to turn on an organic light emitting diode (OLED), and to couple the terminal to an intermediate voltage to turn off the OLED. The second switch is configured to be coupled to the OLED. The second switch is configured to couple the OLED to a second voltage to turn on the OLED, and to couple the OLED to the intermediate voltage to turn off the OLED, the intermediate voltage between the first voltage and the second voltage. The controller is configured to control the first switch and the second switch.

Disclosed is also a method for controlling a display device. An organic light emitting diode (OLED) is turned off by (1) coupling a terminal of a driving transistor of a display device to an intermediate voltage, and (2) coupling an electrode of the OLED of the display device to the intermediate voltage. Moreover, the OLED is turned on by (1) coupling the terminal of the driving transistor to a first voltage, and (2) coupling the electrode of the OLED to a second voltage to turn on the OLED, the intermediate voltage between the first voltage and the second voltage.

In one embodiment, a data value for driving OLED during an emission period of a video frame is provided in response to turning off the OLED. The OLED is configured to emit light during the emission period of the video frame.

In some embodiments, the OLED is turned off during a data write and hold period for storing display data to a capacitor of a display device, and the OLED is turned on during an emission period of the display device, wherein the OLED is configured to emit light during the emission period of the video frame.

The details of one or more embodiments of the subject matter described in this specification are set forth in the accompanying drawings and the description below.

According to an exemplary embodiment of the present disclosure, an organic light-emitting display device can reduce an inrush current. In addition, according to an exemplary embodiment of the present disclosure, the amount of electric current required to drive pixels can be reduced. It should be noted that effects of the present disclosure are not limited to those described above and other effects of the present disclosure will be apparent to those skilled in the art from the following descriptions.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Figure 1:
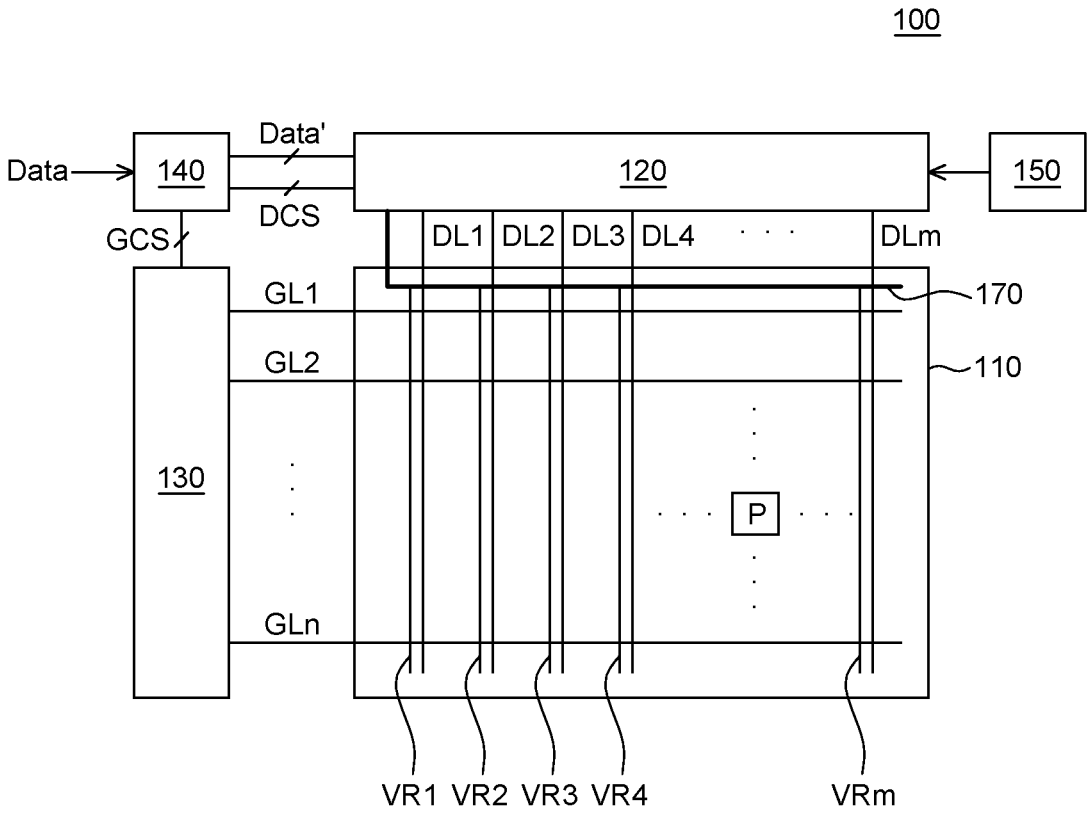
FIG. 1 shows an example of an organic light-emitting display device that may be included in an electronic device.

Advantages and features of the present invention and methods to achieve them will be elucidated from exemplary embodiments described below in detail with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims.

The figures, dimensions, ratios, angles, the numbers of elements given in the drawings are merely illustrative and are not limiting. Like reference numerals denote like elements throughout the descriptions. Further, in describing the present disclosure, descriptions on well-known technologies may be omitted in order not to unnecessarily obscure the gist of the present disclosure. It is to be noticed that the terms "comprising," "having," "including" and so on, used in the description and claims, should not be interpreted as being restricted to the means listed thereafter unless specifically stated otherwise. Where an indefinite or definite article is used when referring to a singular noun, e.g. "a," "an," "the," this includes a plural of that noun unless specifically stated otherwise. In describing elements, they are interpreted as including error margins even without explicit statements.

In describing positional relationship, such as "an element A on an element B," "an element A above an element B," "an element A below an element B," and "an element A next to an element B," another element C may be disposed between the elements A and B unless the term "directly" or "immediately" is explicitly used. As used herein, a phrase "an element A on an element B" refers to that the element A may be disposed directly on the element B and/or the element A may be disposed indirectly on the element B via another element C. As used herein, phrases "an element A connected to an element B" or "an element A coupled with an element B" refer to that the element A may be directly connected to/coupled with the element B, that another element C may be interposed between the element A and the element B, and/or that the element A may be indirectly connected to/coupled with the element B via another element C.

The terms first, second and the like in the descriptions and in the claims are used for distinguishing between similar elements and not necessarily for describing a sequential or chronological order. These terms are used to merely distinguish one element from another. Accordingly, as used herein, a first element may be a second element within the technical idea of the present disclosure.

The drawings are not to scale and the relative dimensions of various elements in the drawings are depicted schematically and not necessarily to scale. Hereinafter, exemplary embodiments of the present disclosure will be described in detail with reference to the accompanying drawings.

FIG. 1 shows an example of an organic light-emitting display device that may be included in an electronic device.

An organic light-emitting display device 100 includes at least one active area, in which an array of pixels is formed. One or more inactive areas may be disposed around the active area. That is, the inactive areas may be adjacent to one or more sides of the active area. The shape/arrangement of the active area and the inactive areas are not particularly limited herein. The active area and the inactive areas may have shapes appropriate for the design of an electronic device employing the organic light-emitting display device 100. The electronic device may be a virtual reality (VR) display device may have a pentagon shape, a hexagon shape, a circle shape, an ellipse shape, etc., for example.

Each of the pixels in the active area may be associated with a pixel circuit. The pixel circuit may include at least one switching transistor and at least one driving transistor on a backplane. Each pixel circuit may be electrically connected to a gate line and a data line to communicate with one or more driving circuits such as a gate driver and a data driver. The driving circuits may be implemented as a TFT (thin film transistor) in the inactive areas. Alternatively, the driving circuits may be mounted on a separate printed circuit board and may be coupled with interconnect interface (pads/bumps, pins, etc.) disposed in the inactive areas via circuit films such as such as a FPCB (flexible printed circuit board), a COF (chip-on-film) and a TCP (tape-carrier-package). The arrangements of such pixel circuits and driving circuits are illustrated in FIG. 1.

As shown in FIG. 1, in the display panel 110, a plurality of data lines DL1, DL2, DL3, . . . , DLm may be arranged in a first direction, and a plurality of gate lines GL1, GL2, . . . , GLn may be arranged in a second direction intersecting the first direction. In addition, a plurality of pixels P may be arranged in a matrix.

When a gate line GL is opened, a data driver 120 converts the image data Data' received from a controller 140 into a data voltage Vdata in the form of analog signal to apply it to the data lines DL1, DL2, DL3, . . . , DLm.

A gate driver 130 sequentially supplies gate signals of an on-voltage or an off-voltage to the gate lines GL1, GL2, . . . , and GLn under the control of the controller 140. The gate driver 130 may be located either on both sides of the display panel 110 or only on one side, depending on the driving manner. In addition, the gate driver 130 may include a plurality of gate driver integrated circuits (ICs), which may be connected to a bonding pad of the display panel 110 by tape automated bonding (TAB) or chip-on-glass (COG), or may be implemented as a gate-in-panel (GIP) such that they may be directly disposed on the display panel 110. Each of the gate driver ICs may include a shift register, a level shifter, etc.

The controller 140 controls the data driver 120 and the gate driver 130 and applies control signals to the data driver 120 and the gate driver 130. The controller 140 starts scanning in accordance with the timing of each frame, converts the image data Data input from a host system into a data signal format used by the data driver 120 to output the converted image data Data', and controls the data driving at an appropriate time according to the scanning. To control the data driver 120 and the gate driver 130, the controller 140 may receive timing signal such as a vertical synchronization signal Vsync, a horizontal synchronization signal Hsync, an input data enable signal, and a clock signal and may generate a variety of control signals to the data driver 120 and the gate driver 130. For example, to control the gate driver 130, the controller 140 may output gate control signals (GCSs) including a gate start pulse (GSP), a gate shift clock (GSC), a gate output enable (GOE) signal, etc. To control the data driver 120, the controller 140 may output data control signals (DCSs) including a source start pulse (SSP), a source sampling clock (SSC), a source output enable (SOE) signal, etc.

The organic light-emitting display device 100 may further include a power controller 150 for applying a variety of voltages or currents to the display panel 110, the data driver 120 and the gate driver 130 or for controlling the variety of voltages or currents to be supplied. The power controller 150 is also referred to as a power management IC (PMIC).

The OLED display 100 may include a plurality of reference voltage lines VR1, VR2, VR3, . . . , VRm for applying reference voltages Vref to the pixels, and a reference voltage link line 170 commonly connected to the plurality of reference voltage lines VR1, VR2, VR3, . . . , VRm. The organic light-emitting display device 100 may also include high-/low-level voltage lines for applying a high-level voltage VDD and a low-level voltage VSS associated with the driving of the pixel circuits.

The organic light-emitting display device 100 may include a variety of additional elements for generating various signals or for driving the pixels in the active area. The additional elements for driving the pixels may include an inverter circuit, a multiplexer, an electro static discharge circuit, etc. The organic light-emitting display device 100 may include elements associated with other features than driving the pixels. For example, the organic light-emitting display device 100 may include additional elements for providing a touch sense feature, a user authentication feature (e.g., fingerprint recognition), a multi-level pressure sense feature, a tactile feedback feature, etc. The above-mentioned additional elements may be disposed in the inactive areas and/or an external circuit connected to the interconnect interface.

Figure 2A:
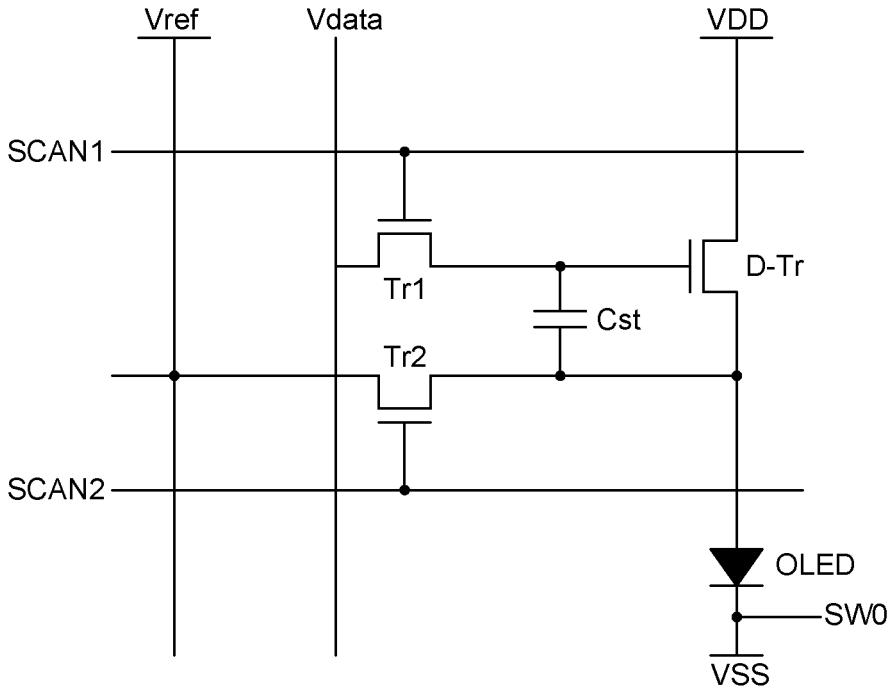
FIGS. 2A to 2C are exemplary diagrams showing a pixel circuit of an organic light-emitting display device used in a VR device and driving of the pixel circuit.
Figure 2B:
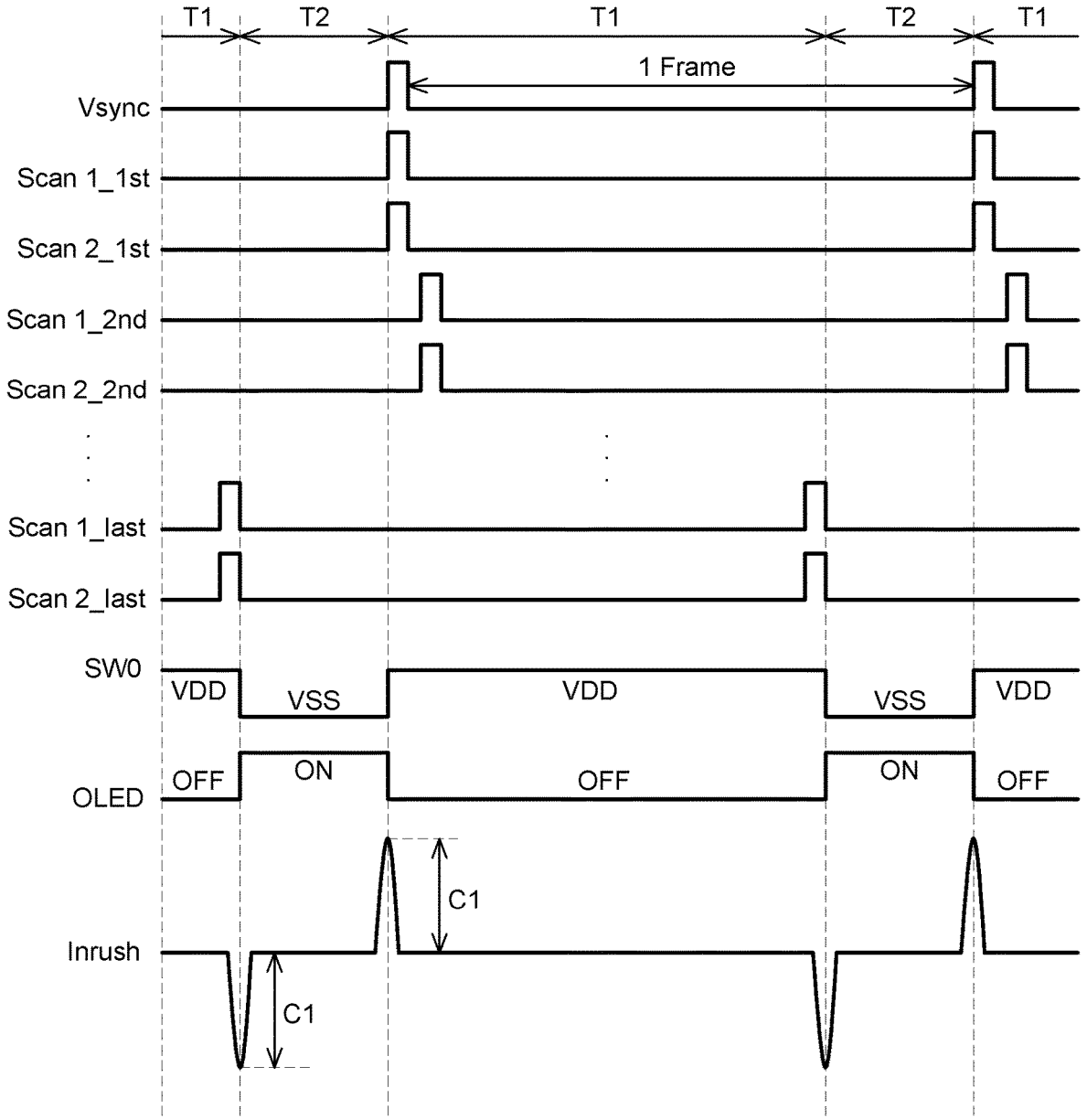
Figure 2C:
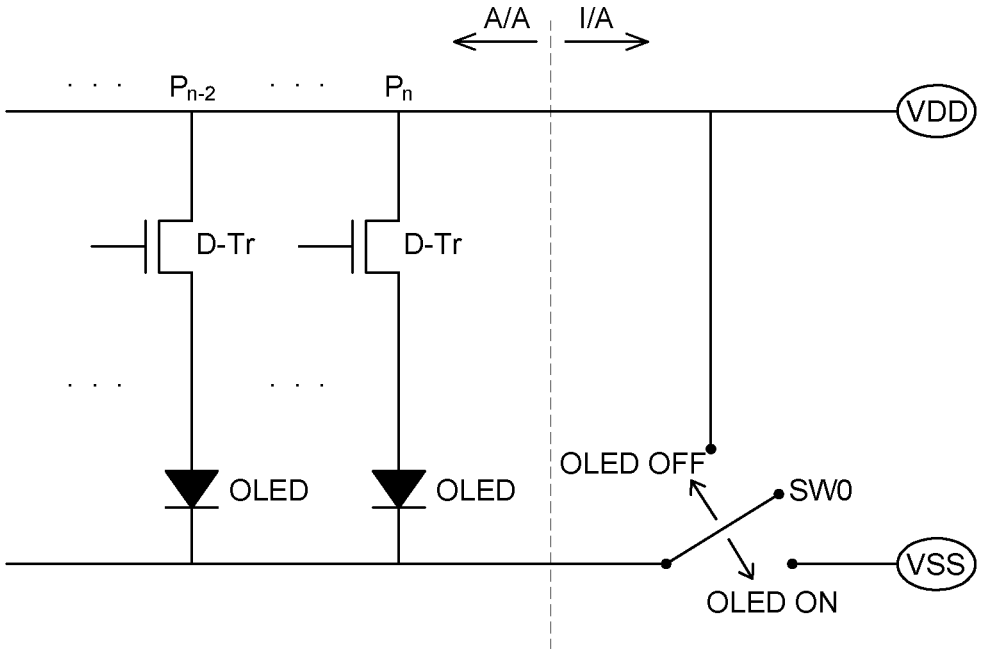

FIGS. 2A to 2C are exemplary diagrams showing a pixel circuit of an organic light-emitting display device used in a VR device and driving of the pixel circuit.

FIG. 2A is a diagram illustrating an example of a unit pixel circuit of the organic light-emitting display device. FIG. 2B is a timing diagram illustrating driving timings of the circuit shown in FIG. 2A. In the organic light-emitting display device used in a VR device, a process of transmitting an image signal (display information) to each pixel is similar to that of typical organic light-emitting display devices.

Referring to FIGS. 2A and 2B, each unit pixel circuit (hereinafter referred to as a pixel circuit) of the organic light-emitting display device 100 includes an organic light-emitting diode (OLED), and a driving transistor D-Tr for supplying current to the OLED to drive the OLED.

The OLED includes a first electrode (e.g., an anode) and a second electrode (e.g., a cathode). An organic emission layer may be disposed between the first electrode and the second electrode. The first electrode of the OLED is connected to the driving transistor D-Tr, and the second electrode thereof is connected to the low-level voltage terminal VSS. The low-level voltage (or base voltage) may be changed between a low voltage and a high voltage under the control of the power controller 150.

A first node of the driving transistor D-Tr is a gate node (G node) and receives a first voltage. A second node of the driving transistor D-Tr is a source node (S node) and receives a second voltage. The first voltage may be a data voltage Vdata for the respective pixel, and the second voltage may be a reference voltage Vref. A third node of the driving transistor D-Tr is a drain node (D node) and receives the high-level voltage VDD. In summary, the driving transistor D-Tr includes the first node (G node) at which the data voltage Vdata is applied, the second node (S node) connected to the first electrode of the OLED, and the third node (D node) connected to the high-level voltage terminal VDD.

The pixel circuit may include a capacitor, e.g., a storage capacitor Cst, connected between the first node (G node) and the second node (S node) of the driving transistor D-Tr. The capacitor Cst holds a constant voltage for one frame.

In addition to the driving transistor D-Tr, each pixel circuit may further include one or more transistors. In some implementations, each pixel circuit may further include one or more capacitors. In the circuit configuration shown in FIG. 2A, the pixel circuit may further include a first transistor Tr1 and a second transistor Tr2.

The first transistor Tr1 is turned on/off or switched by the first gate signal SCAN1 applied through the first gate line. When the first transistor Tr1 is turned on by the first gate signal SCAN1, the first transistor Tr1 applies the data voltage Vdata to the first node (G node) of the driving transistor D-Tr. The second transistor Tr2 is turned on/off or switched by the second gate signal SCAN2 applied through the second gate line. When the second transistor Tr2 is turned on by the second gate signal SCAN2, the second transistor Tr2 applies the reference voltage Vref to the second node (S node) of the driving transistor D-Tr.

The capacitor Cst holds the data information Vgs that is equal to the difference between the data voltage Vdata (=VG) applied to the first node (G node) of the driving transistor D-Tr and the reference voltage Vref (=VS) applied to the second node (S node) for one frame.

Referring to FIG. 2B, a single frame may be divided into a first time period T1 and a second time period T2. The first time period is a data write and hold period in which output data (image signal) is written to each pixel and is held for a predetermined time, and the second time period is an emission period in which light is emitted depending on the written data. The data write & hold period may be further divided into a data write period in which data is written into each pixel, and a data hold period in which the written data is held for a predetermined period of time. The data write & hold period may further include additional operation periods such as a sampling period and an initialization period.

As the gate signals are sequentially applied to the gate lines GL1, GL2, . . . , and gate line in this order, the data write period of each of the pixels may be located sequentially in the order of the gate lines GL1, GL2, . . . , and GLn, as shown in FIG. 2B. As a result, for each of the pixels, the data hold period refers to the rest of the data write & hold period after the data write period has elapsed. Accordingly, the length of the data hold period may vary from pixel to pixel.

The first transistor Tr1 is turned on while the data voltage Vdata is applied to the driving transistor D-Tr during the first time period T1. In other words, the gate signal SCAN1 applied to a pixel remains at the high state during the data write period and remains at the low state during the rest of the period. Accordingly, the first transistor Tr1 is turned on by the gate signal SCAN1 during the data write period to apply the data voltage Vdata to the first node (G node) of the driving transistor D-Tr.

The second transistor Tr2 is turned on while the reference voltage Vref is applied to the driving transistor D-Tr during the first time period T1, to apply the reference voltage Vref to the second node (S node) of the driving transistor D-Tr.

The OLED does not emit light during the first time period T1, i.e., while data is being written to all the pixels. Referring to FIGS. 2B and 2C, since the switch SW0 connected to the cathodes of the OLEDs included in all the pixel circuits is connected to the high-level voltage terminal VDD during the first time period T1, no current flows through the OLED, and thus the OLED does not emit light. On the other hand, when the data has been written in all the pixels and the second time period T2 is started, the switch SW0 is connected to the low-level voltage terminal VSS so that the OLEDs of all the pixels emit light.

In this manner, all the pixels of the organic light-emitting display device are configured to emit light at the same time point (time period) because of the usage environment of the VR device. Usually, a virtual reality (VR) display device is mounted closely to a user's eyes in order to increase the level of immersion. Accordingly, if data write and emission of each pixel are sequentially performed (so-called rolling shutter operation) like other organic light-emitting display devices, the sequential emission of the horizontal lines may be perceived by the user, or a quickly-changing image may be distorted. Therefore, in order to prevent deterioration of the visual sensitivity, the organic light-emitting display device for a VR device is driven such that the OLEDs of all the pixels emit light simultaneously, which is often referred to as global shutter operation.

Although the visibility of the organic light-emitting display device for virtual reality display has been improved by the global shutter operation, there is another problem resulted from the global shutter operation. Specifically, during transition from the first time period T1 to the second time period T2 (or vice versa), that is, when the OLED is switched from the on-state to the off-state or vice versa, a large inrush current may be generated (as indicated by C1 in FIG. 2B). It has been found that the inrush current is generated as the voltage at the cathode terminal of the OLED greatly varies from the high level VDD to the low level VSS according to the operation of the switch SW0. To mitigate the inrush current, a pixel circuit structure capable of reducing voltage fluctuation and accordingly inrush current during the transition between the on- and off-states of the OLED is disclosed hereinbelow.

Figure 3A:
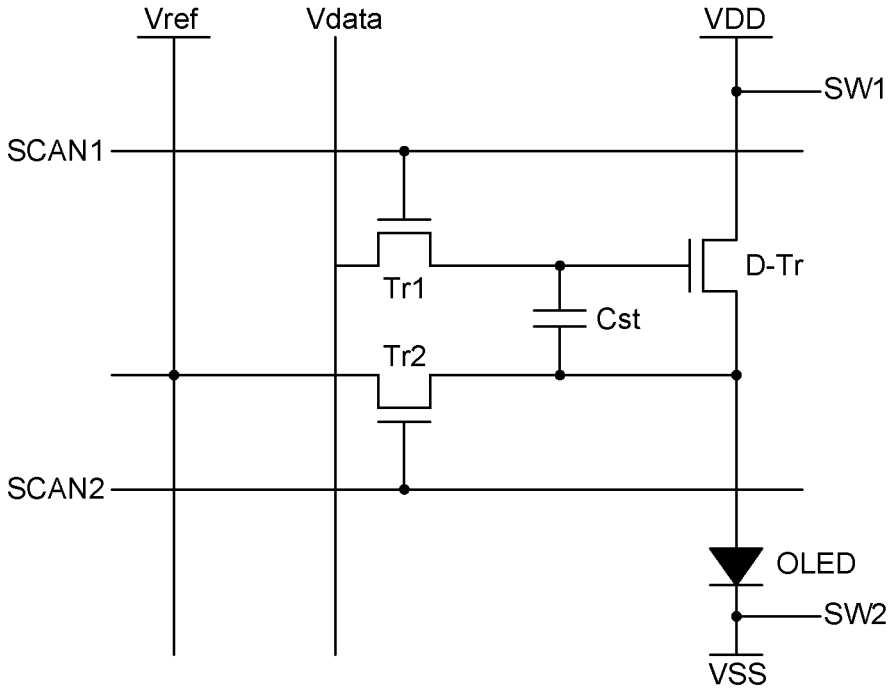
FIG. 3A to 3C are exemplary diagrams showing a pixel circuit of an organic light-emitting display device according to an exemplary embodiment of the present disclosure and the driving manner.
Figure 3B:
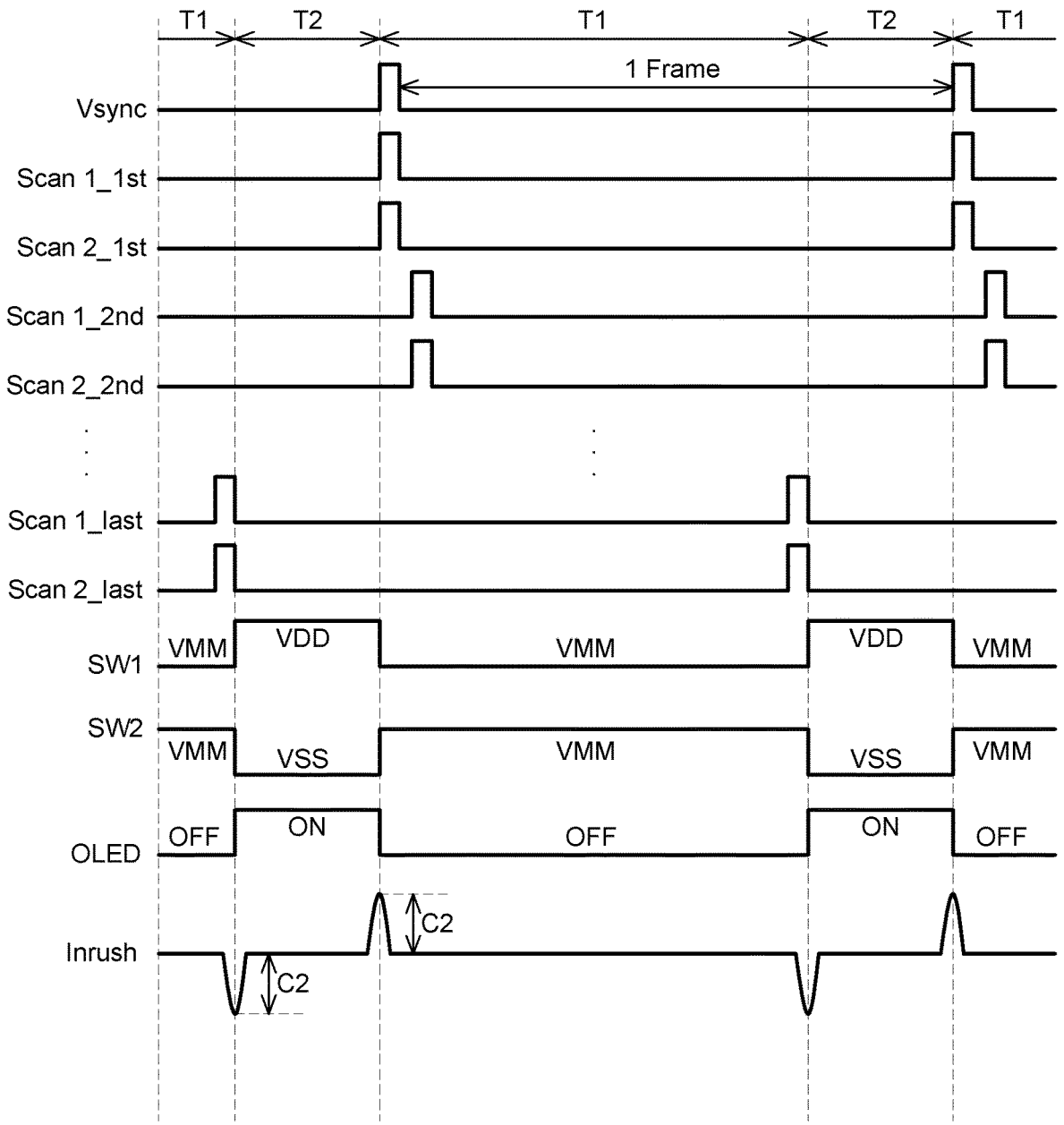
Figure 3C:
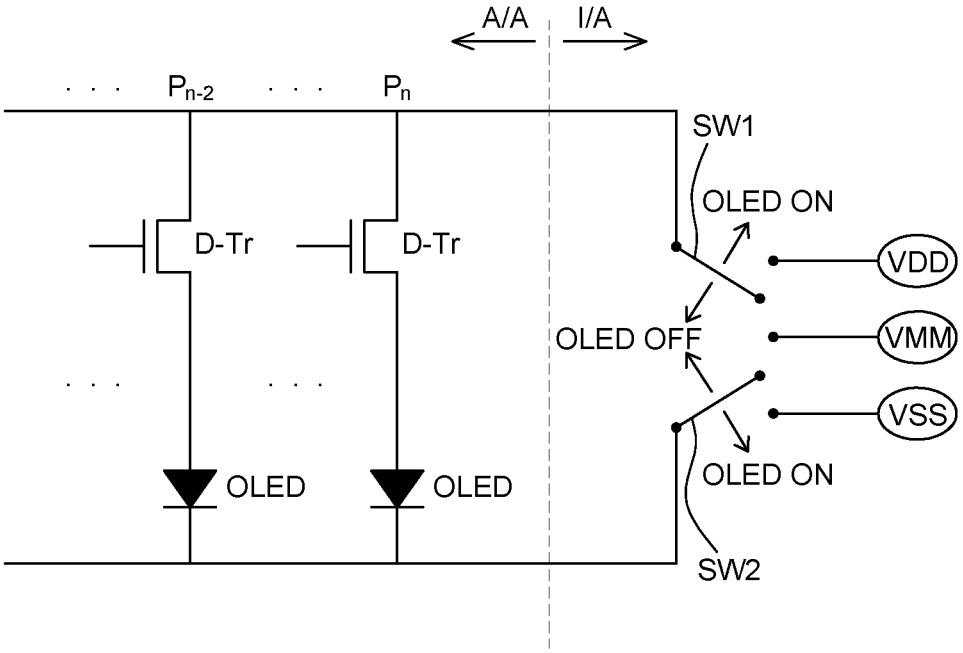

FIG. 3A to 3C are exemplary diagrams showing a pixel circuit of an organic light-emitting display device according to an exemplary embodiment of the present disclosure and the driving manner.

FIG. 3A is a diagram showing a unit pixel circuit of the organic light-emitting display device. FIG. 3B is a diagram showing operation timing of elements included in the pixel circuit. The connective relationship and operation of the elements other than the first switch SW1 and the second switch SW2 are substantially identical to those described above with reference to FIGS. 2A and 2B; and, therefore, the redundant description will be omitted. It is to be noted that the organic light-emitting display device described below includes a first switch SW1 and a second switch SW2 for controlling a global shutter, unlike the device described above with reference to FIGS. 2A to 2C. Therefore, the first switch SW1 and the second switch SW2 will be mainly described.

The organic light-emitting display device according to the exemplary embodiment of the present disclosure can be applied to a virtual reality (VR) device. The organic light-emitting display device includes a plurality of pixel circuits; and a first switch SW1 and a second switch SW2 connected to the plurality of pixel circuits to control a global shutter. Each of the pixel circuits includes a driving transistor D-Tr and an organic light-emitting diode (OLED). The driving transistor D-Tr has a gate electrode; a source electrode connected to the OLED; and a drain electrode connected to the high-potential power voltage terminal VDD. The OLED has an anode connected to the source electrode of the driving transistor D-Tr and a cathode connected to a low-potential power voltage terminal VSS.

The first switch SW1 is disposed between the high-potential power voltage terminal VDD and the drain electrode of the driving transistor D-Transistor. The second switch SW2 is disposed between the low-potential power voltage terminal VSS and the cathode of the OLED. It is to be noted that the drain electrode and the cathode represent the drains and cathodes of all the pixel circuits.

As shown in FIG. 3C, the first switch SW1 and the second switch SW2 are connected to all of the plurality of pixel circuits, to control the emission of the OLEDs included in the plurality of pixel circuits, respectively. That is, the first switch SW1 and the second switch SW2 are operated so that the OLEDs included in the plurality of pixel circuits, respectively, are turned off simultaneously in the first time period T1, and are turned on simultaneously in the second time period T2. As shown in FIG. 3B, the first time period T1 is a period of time in which an image signal (display signal) is transmitted to each of the plurality of pixel circuits. The second time period T2 is a period of time in which the OLED included in each of the plurality of pixel circuits emits light based on the transmitted image signal (e.g., Vdata). Each single frame consists of the first time period T1 and the second time period T2.

The first switch SW1 and the second switch SW2 work to reduce an inrush current generated during the transition from the first time period T1 to the second timing period T2 or the transition from the second time period T2 to the first time period T1. As an approach to do so, the first switch SW1 and the second switch SW2 work to reduce voltage fluctuation generated between the low-potential power voltage VSS and the cathode during the transition from the first time period T1 to the second timing period T2 or the transition from the second time period T2 to the first time period T1.

FIG. 3C shows an example of the first switch SW1 and the second switch SW2. Although FIG. 3C shows that each pixel circuit Pn includes only the driving transistor D-Tr and the OLED for convenience of illustration, it is to be understood that other elements necessary for each pixel circuit Pn are included. The operation of the example circuit is as follows:

<First Time Period T1> The first switch SW1 and the second switch SW2 are both connected to an intermediate-potential power voltage terminal VMM. The intermediate-potential power voltage terminal VMM supplies a voltage having a level between the voltage supplied by the high-potential power voltage terminal VDD and the voltage supplied by the low-potential power voltage terminal VSS. For example, if the voltage supplied by the high-potential power voltage terminal VDD is 10 V (volts) and the voltage supplied by the low-potential power voltage terminal VSS is 0 V, then the voltage supplied by the intermediate-potential power voltage terminal VMM may be 5.5 V. In the first time period T1, the OLEDs are all in the off-state.

<Second Time Period T2>

The first switch SW1 is connected to the high-potential power voltage terminal VDD, and the second switch SW2 is connected to the low-potential power voltage terminal VSS. As a result, the OLEDs are all turned on.

As the first switch SW1 and the second switch SW2 operate in the above-described manner in the first time period T1 and in the second time period T2 within a frame, the OLEDs are turned on and off by the switches. At this time, the width of the voltage fluctuation at the cathode terminal of the OLED is equal to the difference between the intermediate-level voltage and the low-level voltage. As a result, the width of the voltage fluctuation becomes smaller than that of the circuit shown in FIG. 2C in which the voltage at the cathode terminal fluctuates greatly from the high-level voltage to the low-level voltage. Accordingly, the amplitude of the inrush current (C2 in FIG. 3B) is much smaller than that in the circuit in FIG. 2C (C1 in FIG. 2B).

An experiment was carried out with the circuit of FIG. 3 where VDD=10 V, VSS=0 V, and VMM=5.5 V. From the experiment, the inrush current was measured to be approximately 1 A during the transition between the on- and off-states of the OLED. In contrast, in an experiment with the circuit having the configuration shown in FIG. 2C where VDD=10V and VSS=0V, the inrush current was measured to be approximately 2 A. From the above results, it can be seen that that the circuit according to the exemplary embodiment of the present disclosure can reduce the inrush current generated in the global shutter operation to approximately ½.

The first switch SW1 and the second switch SW2 may be disposed outside the pixel circuits (e.g., outside the active area). Furthermore, the organic light-emitting display device may further include a power controller for controlling the first switch and the second switch. The first switch SW1, the second switch SW2 and the power controller may be included in a power management integrated circuit (PMIC) located outside the active area where the pixel circuits are disposed. The power management integrated circuit may be mounted on a chip, a printed circuit board (PCB) or the like and connected to a substrate, or may be implemented directly in an inactive area in a substrate.

As shown in FIG. 3A, each pixel circuit of the organic light-emitting display device 100 according to an exemplary embodiment of the present disclosure may include a first transistor Tr1 electrically connected between a data line DL for supplying data voltage data and a gate electrode of a driving transistor D-Tr and being switched by a first gate signal SCAN1 applied through a first gate line; a second transistor Tr2 electrically connected between a reference voltage line for supplying reference voltage Vref and a source electrode of the driving transistor D-Tr and being switched by a second gate signal SCAN2 applied through a second gate line; and a capacitor Cst electrically connected between the gate electrode and the source electrode of the driving transistor D-Tr.

The first transistor Tr1 is turned on/off or switched by the first gate signal SCAN1 applied through the first gate line. When the first transistor Tr1 is turned on by the first gate signal SCAN1, the first transistor Tr1 applies the data voltage Vdata to the first node (G node) of the driving transistor D-Tr. The second transistor Tr2 is turned on/off or switched by the second gate signal SCAN2 applied through the second gate line. When the second transistor Tr2 is turned on by the second gate signal SCAN2, the second transistor Tr2 applies the reference voltage Vref to the second node (S node) of the driving transistor D-Tr. The capacitor Cst holds the data information Vgs that is equal to the difference between the data voltage Vdata (=VG) applied to the first node (G node) of the driving transistor D-Tr and the reference voltage Vref (=VS) applied to the second node (S node) for one frame.

The organic light-emitting display device having the above-described configuration can reduce an inrush current generated during the global shutter operation, and thus there is an advantage that fluctuations in the EMI (Electro Magnetic Interference), the driving voltage (e.g., VDD) can be reduced.

Figure 4:
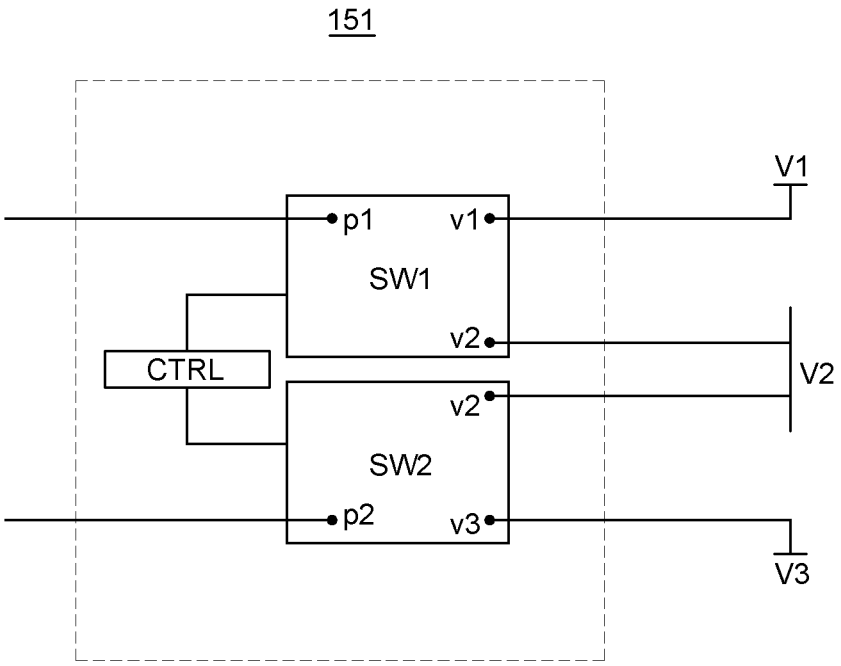
FIG. 4 is a block diagram illustrating a global shutter control circuit according to an exemplary embodiment of the present disclosure.

FIG. 4 is a block diagram illustrating a global shutter control circuit according to an exemplary embodiment of the present disclosure.

The global shutter control circuit 151 may be used in the organic light-emitting display device for a VR device. The global shutter control circuit 151 may perform the global shutter operation described above with reference to FIGS. 3A to 3C. Accordingly, the global shutter control circuit 151 can reduce an inrush current generated in the global shutter operation.

The global shutter control circuit 151 may include a first switch SW1, a second switch SW2, and a controller CTRL. The first switch SW1 works to connect a first terminal p1 connected to the plurality of driving transistors to a first voltage terminal v1 or a second voltage terminal v2. The second switch SW2 works to connect a second terminal p2 connected to the plurality of OLEDs to the second voltage terminal v2 or a third voltage terminal v3. The controller CTRL control the first switch SW1 and the second switch SW2 so that both the first switch SW1 and the second switch SW2 are connected to the second voltage terminal v2 during the first time period, and the first switch SW1 is connected to the first voltage terminal v1 while the second switch SW2 is connected to the third voltage terminal v3 during the second time period.

The first time period is a period of time in which the plurality of OLEDs is turned off. The second time period is a period of time in which the plurality of OLEDs is turned on.

The first terminal p1 of the first switch SW1 may be connected to the drains of the plurality of driving transistors. The second terminal p2 of the second switch SW2 may be connected to the cathodes of the plurality of OLEDs.

The first voltage V1 may be a pixel driving voltage VDD supplied to the drain electrodes of the plurality of driving transistors. The third voltage V3 may be a base voltage VSS supplied to the cathodes of the plurality of OLEDs.

The second voltage V2 has a level between the level of the first voltage V1 and the level of the third voltage V3. For example, when the first voltage V1 is 10 V and the third voltage V3 is 0 V, the second voltage V2 may be 5.5 V.

The first switch SW1, the second switch SW2 and the controller CTRL may be included in the power management integrated circuit (PMIC). The power management integrated circuit may be mounted on a chip, a printed circuit board (PCB) or the like and connected to a substrate, or may be implemented directly in an inactive area in the substrate.

The exemplary embodiments of the present disclosure can also be described as follows:

Thus far, exemplary embodiments of the present disclosure have been described in detail with reference to the accompanying drawings. However, the present disclosure is not limited to the exemplary embodiments, and modifications and variations can be made thereto without departing from the technical idea of the present disclosure. Accordingly, the exemplary embodiments described herein are merely illustrative and are not intended to limit the scope of the present disclosure. The technical idea of the present invention is not limited by the exemplary embodiments. Features of various exemplary embodiments of the present disclosure may be combined partially or totally. As will be clearly appreciated by those skilled in the art, technically various interactions and operations are possible. Various exemplary embodiments can be practiced individually or in combination. The scope of protection sought by the present disclosure is defined by the appended claims and all equivalents thereof are construed to be within the true scope of the present disclosure.

What is claimed is:

1. A display device comprising:

a first pixel comprising:

a first driving transistor having a first terminal and a second terminal, and a first organic light emitting diode (OLED) having a first electrode coupled to the second terminal of the first driving transistor;

a second pixel comprising:

a second driving transistor having first terminal and a second terminal, and a second OLED having a first electrode coupled to the second terminal of the second driving transistor;

a first switch configured to couple the first terminal of the first driving transistor and the first terminal of the second driving transistor to a first voltage to turn on the first OLED and the second OLED during a second period of a video frame, and to couple the first terminal of the first driving transistor and the first terminal of the second driving transistor to an intermediate voltage to turn off the first OLED and the second OLED during a first period of the video frame; and a second switch coupled to the first OLED and the second OLED, the second switch configured to couple a second electrode of the first OLED and a second electrode of the second OLED to a second voltage to turn on the first OLED and the second OLED during the second period of the video frame, and to couple the second electrode of the first OLED and the second electrode of the second OLED to the intermediate voltage to turn off the first OLED and the second OLED during the first period of the video frame, the intermediate voltage between the first voltage and the second voltage, wherein the first period of the video frame is a non-emission period, and the second period of the video frame is an emission period.

2. The display device of claim 1, wherein the first voltage is a first voltage source (VDD), and the second voltage is a second voltage source (VSS), the second voltage source lower than the first voltage source.

3. The display device of claim 2, wherein the second voltage is 0V or ground.

4. The display device of claim 1, wherein the first OLED and the second OLED are turned off during the first period of the video frame, and the first OLED and the second OLED are turned on during the second period of the video frame.

5. The display device of claim 4, wherein the first OLED and the second OLED are configured to emit light during the emission period and the first OLED and the second OLED are configured not to emit light during the non-emission period.

6. The display device of claim 5, wherein the first period is a data write and hold period for storing display data to a capacitor of the display device.

7. The display device of claim 1, further comprising:

a control circuit for controlling the first switch and the second switch.

8. The display device of claim 1, wherein the first terminal of the first driving transistor is a drain terminal, and the second terminal of the first driving transistor is a source terminal.

9. A global shutter control circuit comprising:

a first switch configured to be coupled to a first driving transistor of a first pixel and a second driving transistor of a second pixel, the first switch configured to couple the first driving transistor and the second driving transistor to a first voltage to turn on a first organic light emitting diode (OLED) of the first pixel and a second OLED of the second pixel, and to couple the terminal to an intermediate voltage to turn off the OLED; and a second switch configured to be coupled to the first OLED and the second OLED, the second switch configured to couple the first OLED and the second OLED to a second voltage to turn on the first OLED and the second OLED, and to couple the first OLED and the second OLED to the intermediate voltage to turn off the first OLED and the second OLED, the intermediate voltage between the first voltage and the second voltage; and a controller for controlling the first switch and the second switch;

wherein the controller controls the first switch to couple the first driving transistor and the second driving transistor to the first voltage and controls the second switch to couple the first OLED and the second OLED to the second voltage during a second period of a video frame, and wherein the controller controls the first switch to couple the first driving transistor and the second driving transistor to the intermediate voltage and controls the second switch to couple the first OLED and the second OLED to the intermediate voltage during a first period of the video frame, and wherein the first period is a non-emission period, and the second period of the video frame is an emission period.

10. The global shutter control circuit of claim 9, wherein the first voltage is first voltage source (VDD), and the second voltage is a second voltage source (VSS).

11. The global shutter control circuit of claim 10, wherein the second voltage is 0V or ground.

12. The global shutter control circuit device of claim 9, wherein the first switch is configured to be coupled to a drain of the first driving transistor and a drain of the second driving transistor.

13. The global shutter control circuit device of claim 9, wherein the first OLED and the second OLED are configured to emit light during the emission period and the first OLED and the second OLED are configured not to emit light during the non-emission period.

14. A method comprising:

turning off a first organic light emitting diode (OLED) of a first pixel and a second OLED of a second pixel during a data write and hold period for storing display data to a capacitor of a display device by:

coupling, using a first switch, a terminal of a first driving transistor of the first pixel and a terminal of the second driving transistor of the second pixel to an intermediate voltage, coupling, using a second switch, an electrode of the first OLED and an electrode of the second OLED to the intermediate voltage; and turning on the first OLED and the second OLED during an emission period of the display device by:

coupling, using the first switch, the terminal of the first driving transistor and the terminal of the second driving transistor to a first voltage, and coupling, using the first switch, the electrode of the first OLED and the electrode of the second OLED to a second voltage, the intermediate voltage between the first voltage and the second voltage.

15. The method of claim 14, wherein the first voltage is a first voltage source (VDD), and the second voltage is a second voltage source (VSS).

16. The method of claim 15, wherein the second voltage is 0V or ground.

17. The method of claim 14, further comprising:

responsive to turning off the first OLED and the second OLED, providing a data value for driving the first OLED during an emission period of a video frame, wherein the first OLED is configured to emit light during the emission period of the video frame.

18. The method of claim 14, wherein the first OLED and the second OLED are configured to emit light during the emission period of the video frame.

* * * * *